US005708996A

United States Patent [19]

Marenco

[11] Patent Number: 5,708,996

[45] Date of Patent: Jan. 20, 1998

[54] BED WITH PERIODICALLY MOVABLE TRANSVERSE PANELS

[76] Inventor: Jorge Enrique Marenco, Sarmiento 1942, 5th Fl. A, 1044 Buenos Aires, Argentina, 1044

[21] Appl. No.: 534,014

[22] Filed: Sep. 26, 1995

[30] Foreign Application Priority Data

Sep. 26, 1994 [AR] Argentina ..... 329.574

[51] Int. Cl.[6] ..... A61G 7/057; A61G 7/018

[52] U.S. Cl. ..... 5/613; 5/934; 601/98

[58] Field of Search ..... 5/613, 614, 616, 5/933, 934, 600; 601/98

[56] References Cited

U.S. PATENT DOCUMENTS

| | | | |
|---|---|---|---|
| 2,773,498 | 12/1956 | Himmelman | 601/98 |
| 2,790,440 | 4/1957 | Adair, Jr. | 5/934 |
| 5,233,712 | 8/1993 | Jurus et al. | 5/613 |

FOREIGN PATENT DOCUMENTS

| | | | |
|---|---|---|---|
| 237675 | 9/1988 | Argentina . | |
| 7313917 | 4/1975 | Netherlands | 5/934 |
| 1292768 | 2/1987 | U.S.S.R. | 5/934 |

*Primary Examiner*—Alexander Grosz
*Attorney, Agent, or Firm*—J. Sanchelima

[57] ABSTRACT

A bed for patients that require periodic movement of their body parts. The bed includes a rectangular frame with panel members transversally disposed. Each panel member is supported by a pair of eccentric members that in turn are rigidly mounted to two spaced apart shaft that are parallel to each other. The shafts are imparted a rotational force by a motor assembly that generates a reciprocating movement that is translated to a rotational movement applied to the shafts. The eccentric members cammingly engage the underside of the panels, and they are divided in two sets of eccentric members that are aligned with respect to each other so that each set is composed on non-adjacent alternate panels that are lifted when the panels of the other set are brought down.

3 Claims, 2 Drawing Sheets

BED WITH PERIODICALLY MOVABLE TRANSVERSE PANELS

BACKGROUND OF THE INVENTION

1. Field of the Invention

The present invention relates to therapeutical beds, and more particularly, to those that include a mechanism for moving separate sets of supporting panels.

2. Description of the Related Art

Widely known by the health professionals are the different problems that prolonged stay on a bed brings to patients. One of these originates from lying permanently against one or more of patient's body areas. This is frequently the cause for injuries known as eschars, which consist of black or brown scabs. They are produced as a result of upsetting or disorganizing a tissue in the conditions described. They are injuries similar to the gangrenous type, with an increasing ulceration process with an infectious focus re-fed by the same conditions of the bed bound patient. Thus, while repose is a fundamental factor for effective recovery from numerous illness, in many cases it also can be the source for affections that can seriously compromise the general state of the patient. Thus, the only recourse left to these patients is to take advantage of the ambulatory possibilities left and to try to change their posture while permanently on bed, within the limited possibilities that its dimensions allow. However, there are patients that, due to their delicate health they are in or due to the type of illness they have, cannot move by themselves. In these cases, the situation is more complicated, since an additional service of paramedical personnel has to be dedicated to the patient, with the object of disposing permanent rotative changes of the ill person on the bed. Nevertheless, even in this case, the supports for the body are not many. Through the present invention, this serious problem can be solved by means of a bed that provided with variable supports. The bed includes two sets of alternated panels provided with ascending-descending movement that are disposed alternatively to form the bed. To alternate one and another set of panels, the bed had an ingenious alternative angular actioning device, based on a means of actioning of a fork that commands each axles provided with sets of eccentric levers.

In this way, the present anti-eschar bed turns into an efficient aid to overcome the painful consequences that result from prolonged prostration, constituting a very useful element for the treatment of cases as the ones mentioned above.

Applicant believes that the closest reference corresponds to Argentine patent No. 237,675 that defines an anti-eschar bed with the indicated principle, but according to the illustrated example, it uses means of transmission for ascending-descending movement that do not have adequate efficiency nor provide the same results. The patented bed does not maintain the bed compensated, since it tends to be unbalanced due to the weight of the patient applied to the bed since it concentrates along the body of the patient.

The improvements mentioned in the present application, present a positive solution to the problems of that patented bed, through a system of transmission that, notwithstanding its constitutive simplicity, does not produce an unbalance (as it is disposed in a double form bearing the weight with more equilibrium), and allows smooth ascending-descending movements, of uniform displacement and with great security.

Other patents describing the closest subject matter provide for a number of more or less complicated features that fail to solve the problem in an efficient and economical way. None of these patents suggest the novel features of the present invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
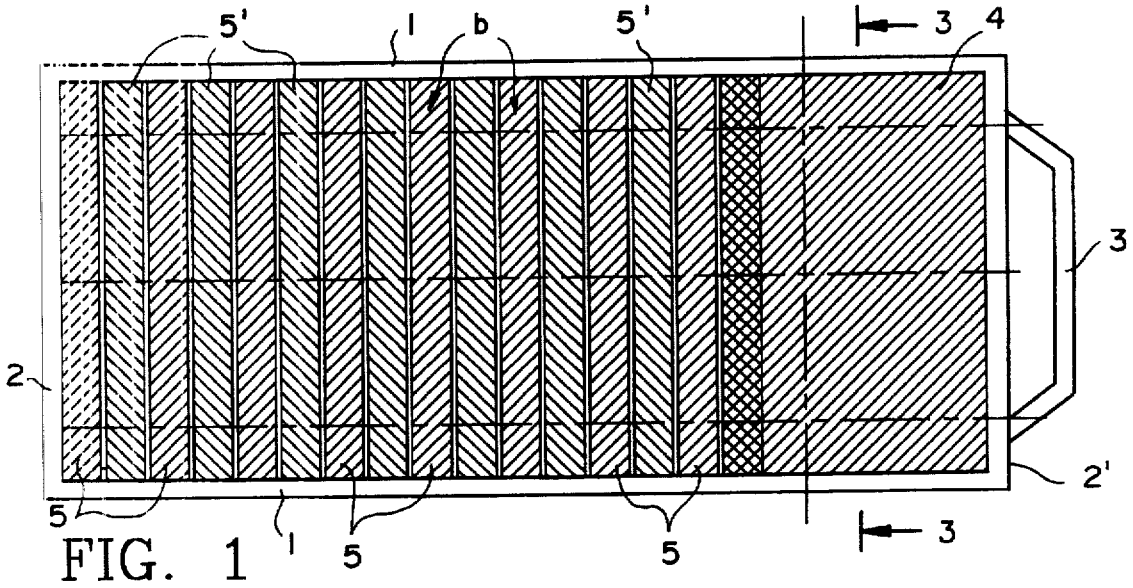
FIG. 1 is a top view of the bed, subject of the present application, with its panels and headboard.
Figure 2:
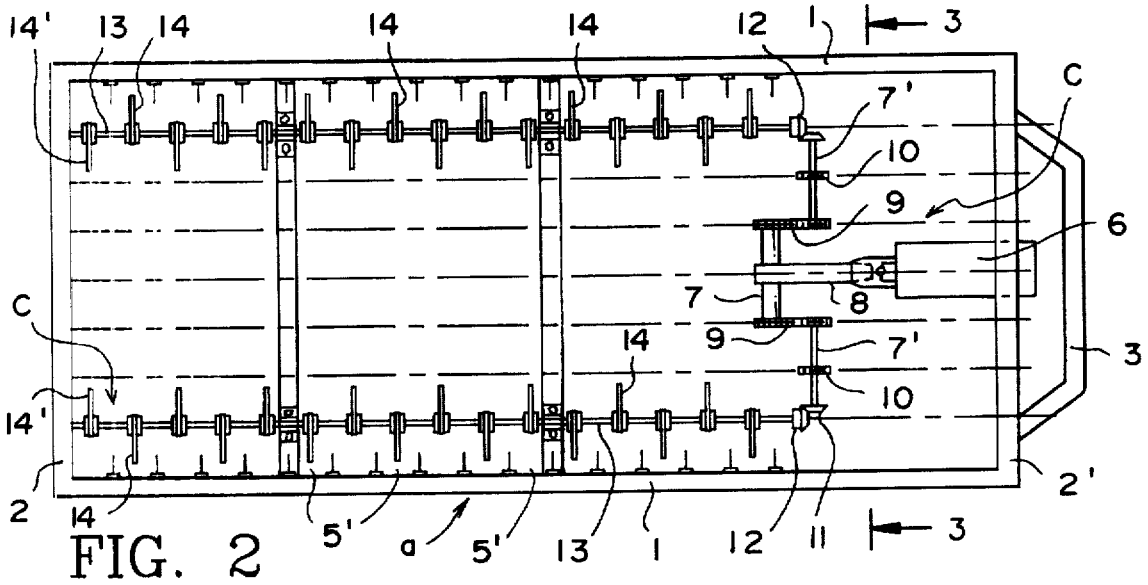
FIG. 2 is a bottom view of the bed shown in FIG. 1.
Figure 3:
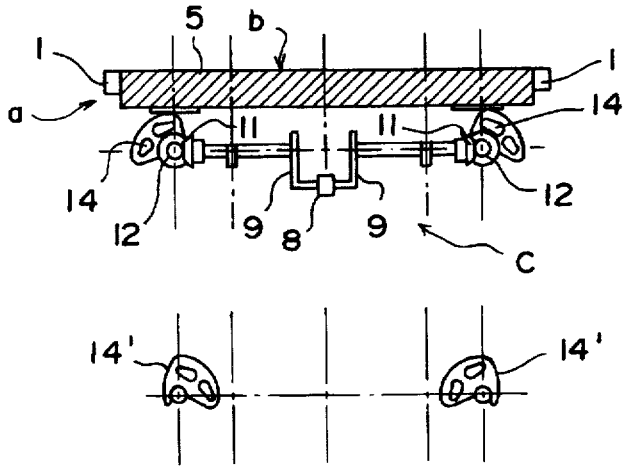
FIG. 3 is a cross-sectional view taken along line 3—3 in FIG. 2.
Figure 5:
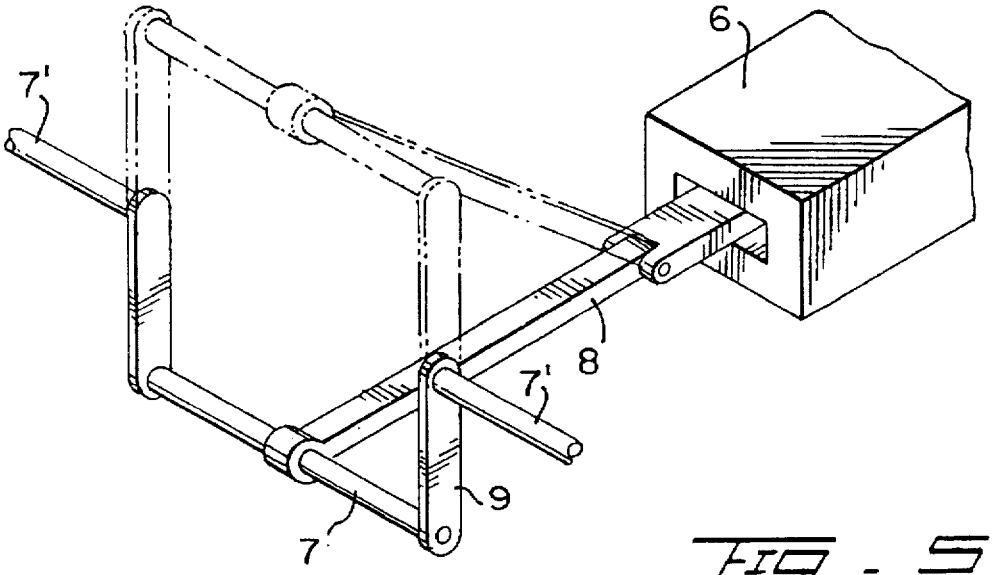
FIG. 5 is a view of the motor assembly and the fork assembly.
Figure 4:
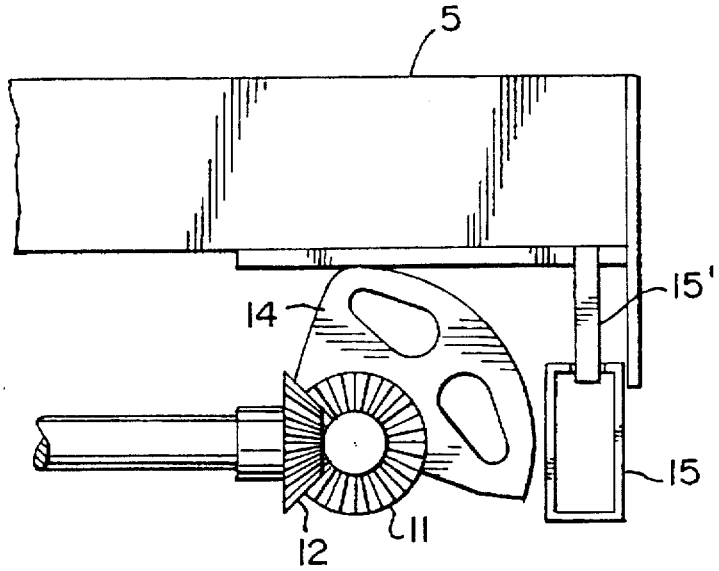
FIG. 4 is similar to FIG. 3 and also showing the displacement guides and guiding bars.

The present anti-eschar bed includes assembly (a) over which litter or bed (b) is conformed to support the patient. Assembling (a) is provided with corresponding supporting legs (not shown) and includes, two longitudinal beams (1) each joined at their ends by crossbars (2) and (2'), that in this way compose a rectangular frame delimiting bed (b).

Bed (b) includes headboard (4) with lintel handle (3) and by a plurality of independent panels (5) and (5') that are transversely disposed with respect to assembly (a). Panels (5) and (5') are adjacent to each other. Each one of these panels (5) and (5') also have, at their ends, guiding bars (15') that project perpendicularly from the underside of panels (5) and (5') slidably with corresponding ascending-descending displacement guides (15) mounted on the longitudinal beams (1) of the assembly (a). In this way, the mentioned panels (5) and (5') are guided with an ascending-descending capacity with reference to the virtual plane of contention of the litter (b), at the same time they provide two actioning sets of panels, independent from each other, alternating so that adjacent panels are in opposite sets. Angular actioning device (c) translates the necessary reciprocating movement from motor assembly (6) which could be implemented with a piston and cylinder assembly, for example.

This device, of angular actioning (c) includes actioning or motor assembly (6) that actuates fork assembly (c') that can be a handle-connecting rod mechanism, a worm that engages with an indented wheel actioned with a handle or a hydraulic cylinder. Fork assembly (c') comprising a connecting rod (8) connected to a crankshaft axle (7—7'), the latter including a trunnion (7) and two handles (9) connected to two ends (7') that each end in conical driving gears (11). On their part, these driving gears (11) engage to respective conical driven gears (12) mounted on corresponding longitudinal axles (13) disposed under litter (b).

At the same time, on each one of these longitudinal axles (13), rotative eccentric levers (14) and (14') are rigidly mounted in different angular disposition for the panels from different sets, in such way that they compose two intercalated sets that, alternatively, actuate one and another set of panels (5) and (5'). Eccentric levers (14) and (14') cammingly engage with the underside of panels (5) and (5') to lift one set of panels (5) while the adjacent panels (5') in the other set are lowered.

Through motor assembly (6) of the fork (c'), the crankshaft axle (7—7') is moved with conical driving gears (11) transmitting the movement to the respective driven gears (12) mounted at the end of the longitudinal axles (13). In this way, the sets of eccentric levers (14) and (14') support by their peripheries the underside of panels (5) and (5'). Each set of levers (14) and (14') have a different angular position causing panels (5) and (5') to be displaced at different heights with respect to the plane of litter (b).

It cannot be doubted that when the present invention is put into practice, modifications can be introduced concerning certain details in construction and shape, without implying getting apart from the fundamental principles that are clearly substantiated in the clauses of the following claims.

I claim:

1. A bed for patients that require periodic movement of their body parts, comprising:

A) a rectangular frame (20);

B) a plurality of panel members (5,5') transversely disposed across said frame (20) including guiding means (15,15') for keeping said panel members (5,5') from moving along the plane of said rectangular frame and permitting said panel members to move only perpendicularly with respect to the plane of said rectangular frame (20);

C) at least two spaced apart and parallel shafts (13) disposed in a plane in parallel and spaced apart relationship with respect to said panel members (5,5') and below said frame (20) and said shafts (13) longitudinally extending therealong;

D) a plurality of eccentric members (14) mounted on said shafts (13) and said eccentric members being in cooperative cammingly engagement with said panel members (5,5') to cause the latter to move up and down as said shafts (13) rotate and said eccentric members (14) corresponding to two sets of non-adjacent eccentric members (14) that are aligned with respect to those within the same set; and E) means (c) for delivering a rotational force to said shafts (13).

2. The bed set forth in claim 1 wherein said eccentric members (14) are alternatively aligned so that panels engaged with one of said sets of eccentric members (14) are lifted when adjacent panels are brought down.

3. The bed set forth in claim 2 wherein said means (c) for delivering a rotational force to said shafts (13) includes a crankshaft assembly and gear means for transmitting said rotational force to said shafts (13).

* * * * *